US007618272B2

(12) United States Patent
Cheng

(10) Patent No.: US 7,618,272 B2
(45) Date of Patent: Nov. 17, 2009

(54) ELECTRICAL CARD CONNECTOR WITH A DUSTPROOF DEVICE

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/075,602

(22) Filed: Mar. 12, 2008

(65) Prior Publication Data

US 2008/0227317 A1 Sep. 18, 2008

(30) Foreign Application Priority Data

Mar. 12, 2007 (TW) ..... 96203926 U

(51) Int. Cl.
*H01R 13/62* (2006.01)

(52) U.S. Cl. ..... 439/159; 439/138

(58) Field of Classification Search ..... 439/159, 439/160, 607, 630, 138, 137, 135, 142, 607.22
See application file for complete search history.

(56) References Cited

U.S. PATENT DOCUMENTS 6,120,322 A 9/2000 Ho et al.
6,368,123 B2 4/2002 Uchiyama et al.
6,887,087 B2 5/2005 Lai et al.
6,988,904 B1 * 1/2006 Lai ..... 439/159
7,018,222 B2 * 3/2006 Chang ..... 439/159
7,037,123 B2 * 5/2006 Nakamura et al. ..... 439/152
7,090,537 B1 * 8/2006 Nakamura ..... 439/630
7,097,475 B2 * 8/2006 Cheng ..... 439/138
7,150,650 B2 * 12/2006 Kuo ..... 439/607
7,232,320 B2 * 6/2007 Kuo ..... 439/159
7,351,108 B2 * 4/2008 Ting et al. ..... 439/630
7,445,477 B2 * 11/2008 Ting et al. ..... 439/159
7,484,974 B2 * 2/2009 Wu ..... 439/159

* cited by examiner

*Primary Examiner*—Xuong M Chung-Trans
(74) *Attorney, Agent, or Firm*—Andrew C. Cheng; Wei Te Chung; Ming Chieh Chang

(57) ABSTRACT

An electrical card connector comprises an insulative housing, a shell covering the insulative housing, a plurality of terminals received in the insulative housing, an ejecting mechanism assembled on one side of the shell and a dustproof device. The dustproof device retains on the shell away from the terminals, witch comprises a door member, a base portion and a pair of vertical wall extending downwardly from opposite sides of the base portion separately. A horizontal wall extends horizontally from one side of the base portion for retaining the ejecting mechanism. A engagement portion extends outwardly from each vertical wall for holding the electrical card connector. The dustproof device has a simple structure and can be assembled easily and firmly.

3 Claims, 5 Drawing Sheets

ELECTRICAL CARD CONNECTOR WITH A DUSTPROOF DEVICE

BACKGROUND OF THE INVENTION

1. Field of the Invention

The present invention generally relates to an electrical card connector, and more particularly to an electrical card connector with a dustproof device.

2. Description of Prior Art

With the development of portable computer, the dimension of the portable computer gets more and more smaller so that the computer needs more memory cards to meet the requirement. Accordingly, the electrical card connectors are widely used in the portable computer. However, the portable computer is often used in outdoor situation, the dust easily enters into the interior of the portable computer through the opening of electrical card connector. Too much dust may influence the work of the portable computer, and even shorten the life of the portable computer. Accordingly, the electrical card connector always has a door for stopping the dust to enter into the interior of the portable computer.

U.S. Pat. No. 6,368,123 discloses an electrical card connector device with a dustproof device. The dustproof device comprises a frame, a door member assembled on the frame and a pair of holding members extending forwardly from opposite sides of the frame. The electrical card connector device is retained on a Printed Circuit Board (PCB) by the holding members. As the holding members are very slim, themselves are easily deformed to influence the work of the device. The electrical card connector device further comprises an ejecting mechanism assembled on one side of the shell. After the ejecting mechanism frequently used, the ejecting mechanism and the shell may be separated each other, and the function of the ejecting mechanism is expired.

Hence, it is desirable to have an improved card connector to overcome the above-mentioned disadvantages of the prior art.

BRIEF SUMMARY OF THE INVENTION

Accordingly, the object of the present invention is to provide an electrical card connector having an improved dustproof device with a simple structure capable of steadily assembled to the electrical card connector.

In order to achieve the above-mentioned object, An electrical card connector comprises: an insulative housing; a plurality of terminals received in the insulative housing; a shell covering the insulative housing; a card receiving space defined by the insulative housing and the shell; an ejecting mechanism located at one side of the shell; and a dustproof device assembled on the shell opposite to the terminals, comprising a base portion, a pair of vertical walls extending downwardly from opposite sides of the base portion, respectively, a horizontal wall extending horizontally from one side of the base portion to retain with the ejecting mechanism, a pair of engagement portions extending outwardly from a lower portion of vertical walls, respectively, and a door member with a pair of posts formed at the opposite ends thereof and respectively assembled on the top positions of the vertical walls, the ejecting mechanism disposed in a space defined by the horizontal wall, the vertical wall and the engagement portion.

Other objects, advantages and novel features of the invention will become more apparent from the following detailed description of the present embodiment when taken in conjunction with the accompanying drawings.

DETAILED DESCRIPTION OF THE INVENTION

Figure 1:
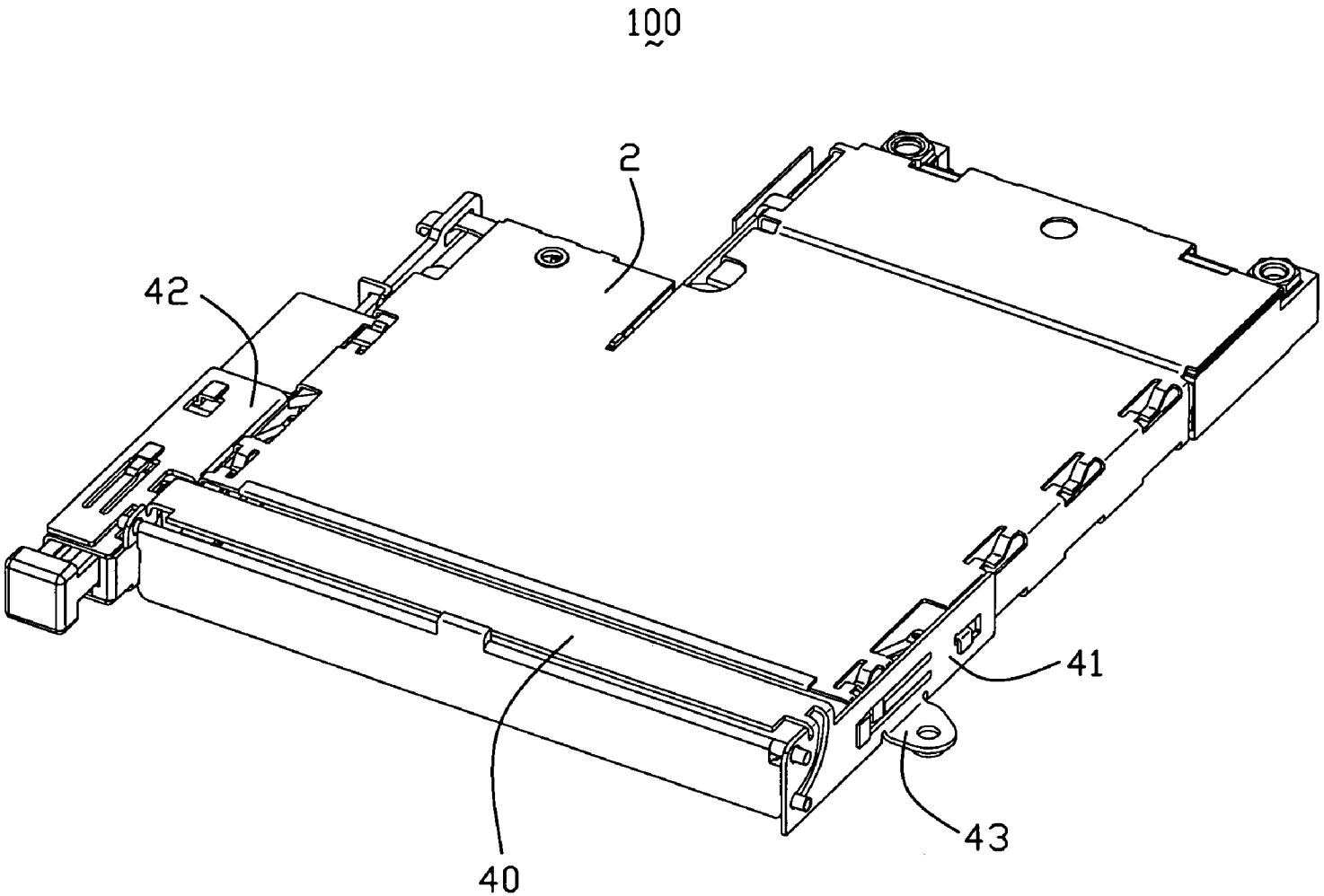
FIG. 1 is a perspective view of an electrical card connector in accordance with the present invention.

Reference will now be made to the drawing figures to describe the present invention in detail.

Referring to FIGS. 1-4, an electrical card connector 100 in accordance with the present invention comprises an insulative housing 1, a shell 2 covering the insulative housing 1, a plurality of terminals 5 received in the insulative housing 1, an ejecting mechanism 3 assembled on one side of the shell 2 and a dustproof device 4 opposite to the terminals. A card receiving space (not labeled) is defined by the insulative housing 1 and the shell 2.

Figure 2:
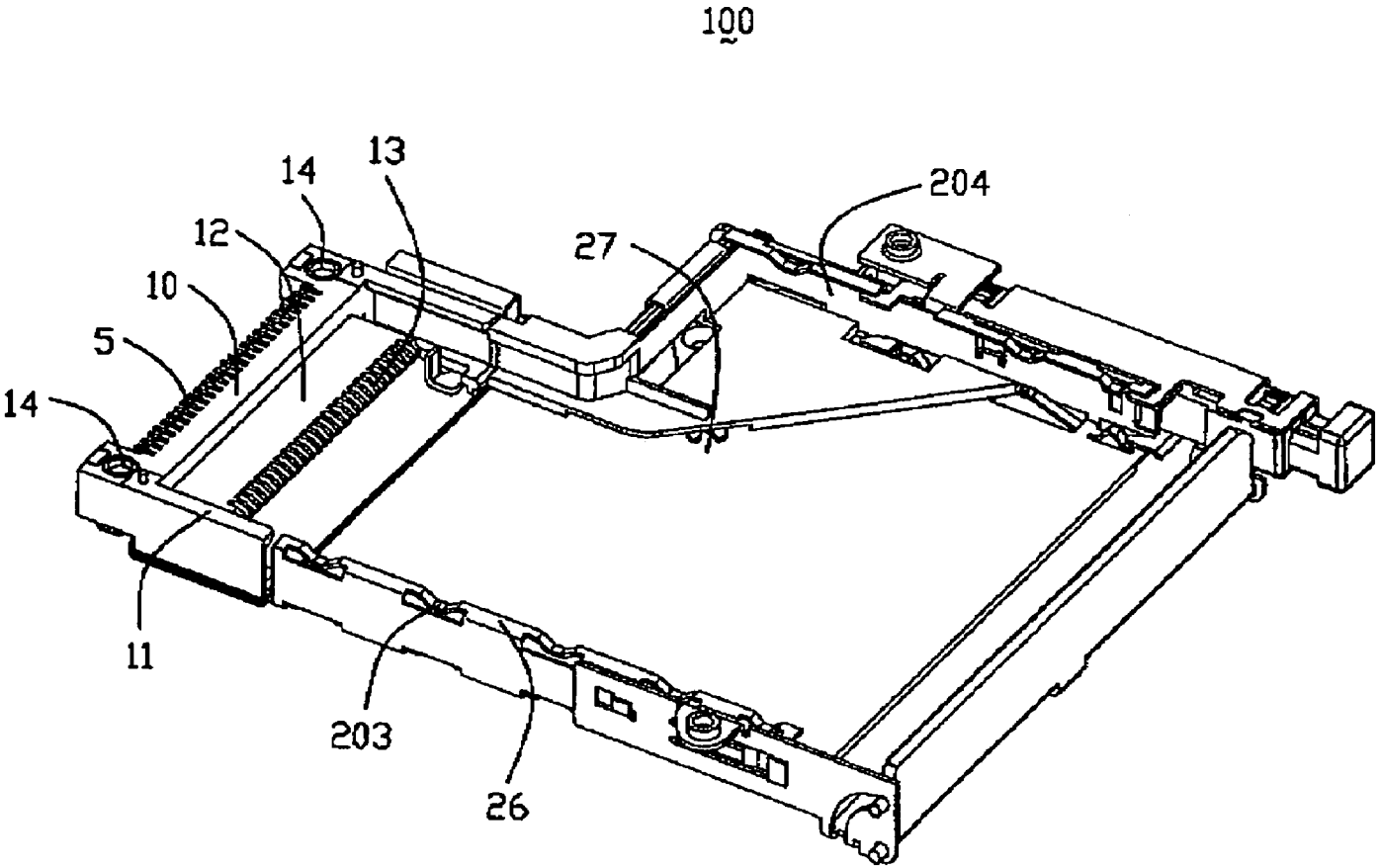
FIG. 2 is another perspective view of the electrical card connector shown in FIG. 1.
Figure 3:
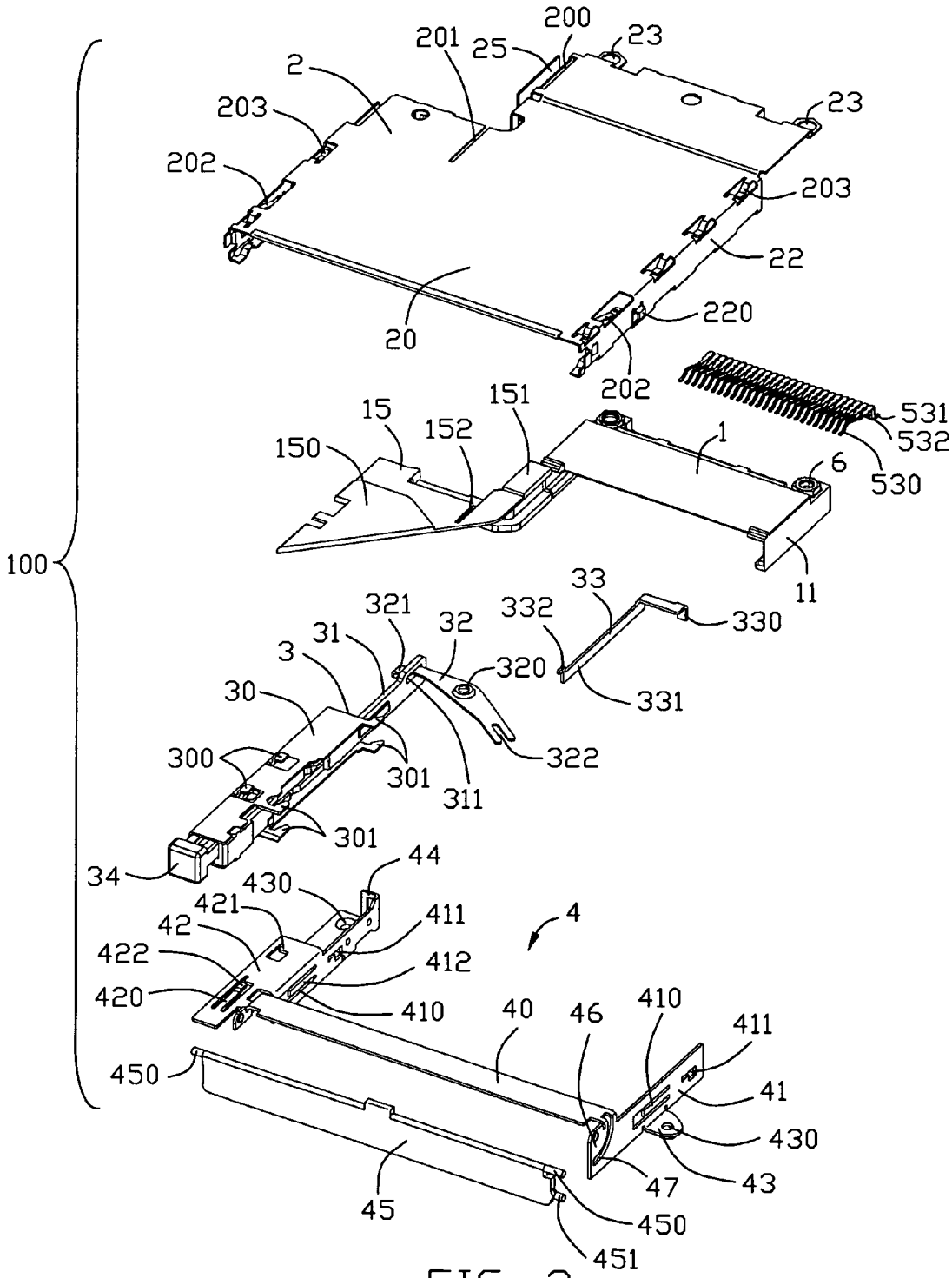
FIG. 3 is an exploded, perspective view of the electrical card connector shown in FIG. 1.

Referring to FIG. 2 and FIG. 3, the elongated insulative housing 1 comprises a base 10, a pair of guiding arms 11 located at opposite sides of the base 10, and a mating portion 12 extending backwardly from the base 10 and disposed between the two guiding arms 11. The mating portion 12 defines a plurality of passages 13 for receiving the terminals 3. Each guiding arm 11 comprises a thread hole 14 in the front thereof for mating with a nut 6.

The terminals 5 are received in corresponding passages 13 of the insulative housing 1 and extend into the card receiving space for electrically connecting with an electrical card. Per terminal 5 comprises a contact portion 530, a retention portion 532 extending forwardly from the contact portion 530 and a solder portion 531 for soldering the terminal 3 to PCB (not shown).

Figure 4:
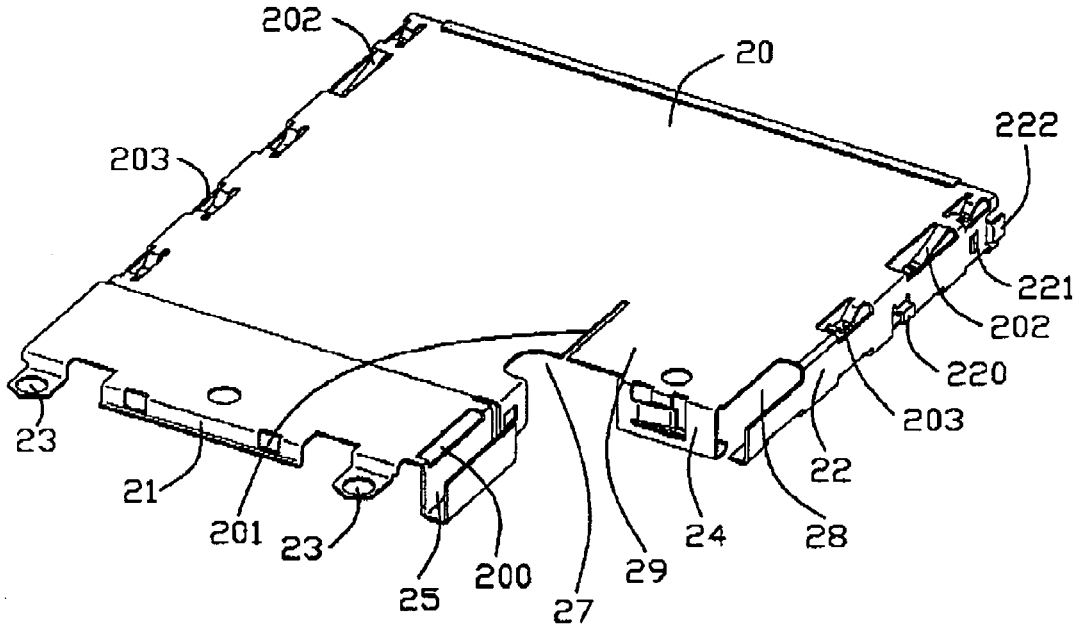
FIG. 4 is a perspective view of a shell of the electrical card shown in FIG. 1.

Referring to FIG. 3 and FIG. 4, the shell 2 is configured of an L-shape covering on housing 1, and comprises a top wall 20, a pair of lateral walls 22 bent downwardly from lateral edges of the top wall 20, and a front wall 21 bent downwardly from a front edge of the top wall 20, these walls together define the card receiving space. The top wall 20 with an L-shape configuration, defines a plurality of protrusion 203 formed at lateral edges thereof and projecting into the card receiving space. A pair of springs 202 are formed, respectively, between two adjacent protrusion 203 of the lateral sides of the top wall 20. Similarly, lateral walls 22 bent inwardly to form a pair of short pieces 26 (shown in FIG. 2), and a plurality of protrusion 203 formed at two short pieces 26 and arrayed in a line. These protrusion 203 and springs 202 together define a pair of guiding slots 204 for guiding the insertion of the electrical card. A pair of retention pieces 23, located at lateral sides of front wall 21, communicate with the thread hole 14 of the insulative housing 1. The nuts 6 mate with the thread hole 14 and the retention pieces 23 for fixing the shell 2 and the insulative housing 1 together. Moreover, an U-shaped sidewall 25 is formed beside the front end of the shell 2. A transverse sidewall 24 extends downwardly from a transverse side of the top wall 20, and a slot 201 is defined at the top wall 20 in a line with the U-shaped sidewall 25. A plurality of holding portions 220, 221, 222 extend along different directions respectively. The L-shaped metallic shell 2 has an outer section 28 and an inner section 27 linked by a horizontal section 29. The slot 201 is defined around an intersection of said inner section 27 and said horizontal section 29.

A guide member 15, approximately in a triangular shape and disposed on one end of the guiding arm 11 adjacent to the insulative housing 1, comprises a board 150 and an L-shaped perpendicular wall 151 extending forwardly and downwardly from a front end of the board 150. The board 150 defines a passageway 152 communicating with the slot 201 of the shell 2 along a vertical direction.

Figure 5:
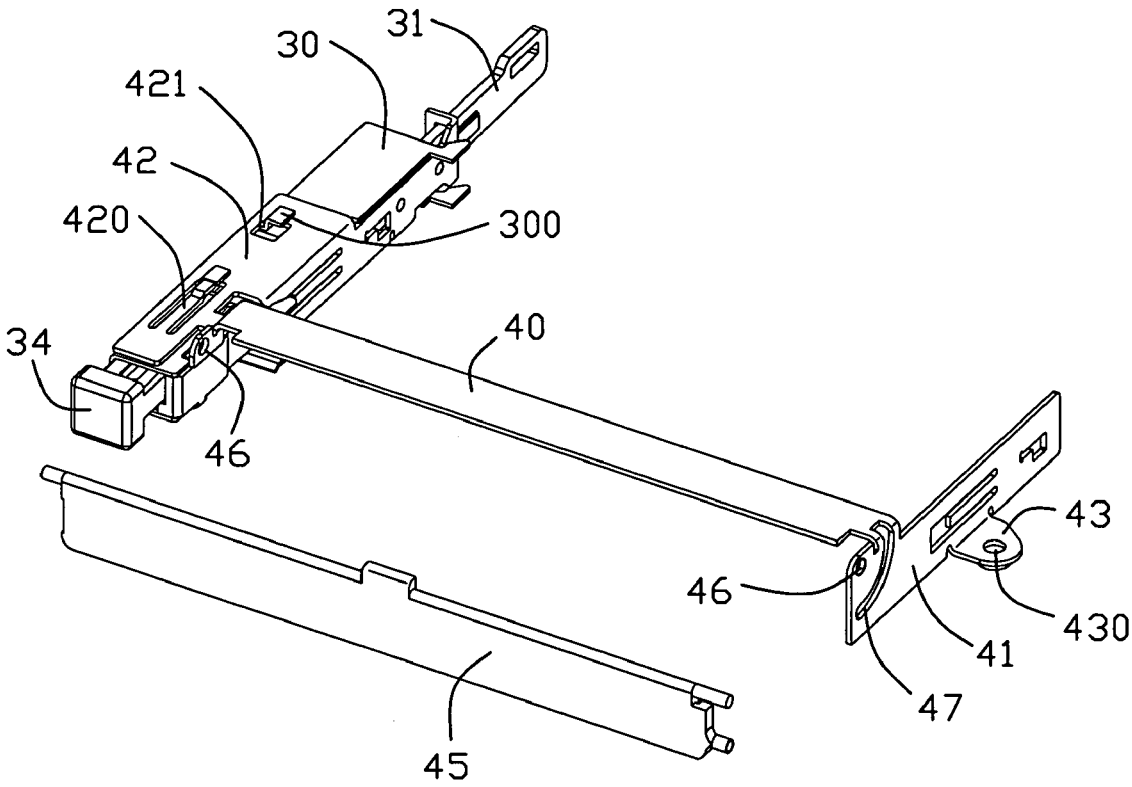
FIG. 5 is a perspective view of a dustproof device of the electrical card shown in FIG. 1.

Referring to FIG. 3 and FIG. 5, the ejecting mechanism 3 comprises a push member 34, a moveable member 31, a pivoting member 32 and an ejecting member 33. The push member 34 is received in a frame 30, which comprises a top horizontal portion (not labeled) with a pair of locking pieces 300 thereon and a low horizontal portion (not labeled). Each lateral side of horizontal portion further comprises a plurality of hooks 301 for holding the ejecting mechanism 3 on the shell 2. A part of the moveable member 31 is also received in the frame 30 moveably. One end 321 of the pivoting member 32 is received in a rectangular hole 311 of the moveable member 31. The other end 322 is bifurcated to receive a rear end 332 of the ejecting member 33. The pivoting member 32 further comprises a pivoting portion 320 in a middle portion thereof to be pivotally held in a pivoting hole (not labeled) of the shell 2. The ejecting member 33 comprises an ejecting portion 330 passing through an opening 200 of the shell 2 to be exposed into the card receiving space for ejecting the electrical card, and a body portion 331 connects the ejecting portion 330 and the rear end 332. A front section of the body portion 331 is moveably received in the U-shaped sidewall 25 in the front-to-back direction. The rear end 332 of the ejecting member 33 moves along the slot 201 and the passageway 152. Detailed description on work process and assembly of the ejecting mechanism 3 omits thereafter, for it is obvious to an ordinary skilled person in this art. The pivoting member 32 is pivotally mounted around said horizontal section 29, the moveable member 31 is linked on an outer end 321 of the pivot member 32 and located around the outer section 28, and an ejecting member 33 is linked on an inner 322 end of the pivot member 32 and located around the inner section 27. The ejecting member 33 defines a rear end 332 extend through said slot 201 for guiding movement of the ejecting member 33 along a front-to-back direction. The inner section 27 of the shell 2 defines an opening 200, and a front end of said ejecting member 33 extends through said opening 200 and enter the card receiving space around the housing 1.

The dustproof device 4 is assembled on the shell 2 opposite to the terminals 5, and comprises a base portion 40, a first and second vertical walls 41 extending downwardly from opposite side of the base portion 40, a horizontal wall 42 extending horizontally from one side of the base portion 40 for holding the ejecting mechanism 3, a pair of engagement portions 43 extending outwardly from a lower portion of each vertical wall 41 with a through hole 430 thereon and a door member 45. The horizontal wall 42 comprises a pair of cutouts 420, 421 to mate with the locking pieces 300 of the frame 30 to make the ejecting mechanism 3 assembled on the dustproof device 4 steadily. The cutout 420 is longer than the cutout 421 in the front-to-back direction with a metal spring 422 therein. The metal spring 422 is against on one of the locking pieces 300 to prevent the frame 30 from moving. Another pair of cutouts 410, 411 of the vertical walls 41 have the same structure with the cutouts 420, 421 of the horizontal wall 42, and mate with the holding portions 220, 221, 222 to hold the dustproof device 4 on the lateral walls 22 of the shell 2. The first vertical wall 41 bends outwardly to form a holding member 44 with a holding hole (not labeled) therein, and the moveable member 31 passes through the holding hole of the holding member 44. Each rear end of the vertical walls 41 defines a hole 46 adjacent to the base portion 40. The second vertical walls 41 further defines a track 47 around the hole 46 thereof. The door member 45 is assembled between the first and second vertical walls 41 and comprises a main portion (not labeled), a pair of posts 450 formed at the opposite ends of the main portion and a positioning post 451 under one of the posts 450. The posts 450 are pivotally held in corresponding holes 46. The positioning post 451 received in the track 47 and capable of rotating around the post 450.

When the electrical card is inserted into the electrical card connector 100, the front end of the card pushes the door member 45 of the dustproof device 4, and the positioning post 451 moves along the track 47 to a top position. When the card is withdrawn from the electrical card connector 100, the door member 45 resumes to an original position automatically by the weight of itself. In such a way, dust is stopped out of the electrical card connector 100. The dustproof device 4 also can be used for holding the ejecting mechanism 3 steadily to prevent the dustproof device 4 from loosing from with the electrical card connector 100. For integrating a pair of engagement portions 43 on the dustproof device 4, it can reduce the accessory of the electrical card connector 100 and assembly process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing;

an L-shaped metallic shell covering said housing and essentially defining a step side, with an outer section and an inner section linked by a horizontal section, and a straight side sideward opposite to each other, said shell cooperating with said housing to define an L-shaped card receiving space;

a plurality of terminals disposed in the housing with contacting sections extending into the card receiving space;

an ejecting mechanism disposed along the step side and including a pivot lever pivotally mounted around said horizontal section, a moveable member linked on an outer end of the pivot lever and located around the outer section, and an ejecting bar having a rear end linked on an inner end of the pivot lever and located around the inner section; wherein said shell defines a slot around an intersection of said inner section and said horizontal section, and said rear end extends through said slot for guiding movement of the ejecting bar along a front-to-back direction; wherein said ejecting mechanism is attached to a dustproof member which is assembled to the shell around a front opening of the card receiving space; wherein the doorproof member comprising a base portion, a horizontal wall extending horizontally from one end of the base portion, and a vertical wall extending downwardly from the horizontal wall, the vertical wall bends outwardly to form a holding member with a holding hole therein, the moveable member passes through the holding hole of the holding member.

2. The electrical connector as claimed in claim 1, wherein an insulative guide member is assembled to the shell with a wedge face thereof, and defines a passageway communicatively aligned with the slot in a vertical direction.

3. An electrical connector comprising:

an insulative housing;

an L-shaped metallic shell covering said housing and essentially defining a step side, with an outer section and an inner sections linked by a horizontal section, and a straight side sideward opposite to each other, said shell cooperating with said housing to define an L-shaped card receiving space;

a plurality of terminals disposed in the housing with contacting sections extending into the card receiving space;

an ejecting mechanism disposed along the step side and including a pivot lever pivotally mounted around said horizontal section, a moveable member linked on an outer end of the pivot lever and located around the outer section, and an ejecting bar having a rear end linked on an inner end of the pivot lever and located around the inner section; wherein said ejecting mechanism is attached to a dustproof member which is assembled to the shell around a front opening of the card receiving space; wherein the doorproof member comprising a base portion, a horizontal wall extending horizontally from one end of the base portion, and a vertical wall extending downwardly from the horizontal wall, the vertical wall bends outwardly to form a holding member with a holding hole therein, the moveable member passes through the holding hole of the holding member.

* * * * *